US005387523A

United States Patent [19]

Monticello

[11] Patent Number: 5,387,523

[45] **Date of Patent: * Feb. 7, 1995**

[54] MULTISTAGE PROCESS FOR DEEP DESULFURIZATION OF FOSSIL FUELS

[75] Inventor: Daniel J. Monticello, The Woodlands, Tex.

[73] Assignee: Energy BioSystems Corporation, The Woodlands, Tex.

[ * ] Notice: The portion of the term of this patent subsequent to Aug. 3, 2010 has been disclaimed.

[21] Appl. No.: 99,100

[22] Filed: Jul. 29, 1993

Related U.S. Application Data

[63] Continuation-in-part of Ser. No. 669,914, Mar. 15, 1991, Pat. No. 5,232,854.

[51] Int. Cl.[6] ..... C10G 32/00; C12S 1/00; B66D 1/20; C10L 5/00

[52] U.S. Cl. ..... 435/282; 435/262; 435/281; 435/252.5; 435/243; 44/622; 44/624

[58] Field of Search ..... 435/262, 262.5, 281, 435/282, 820, 832, 843, 252.31, 252.5, 243; 44/622, 624

[56] References Cited

U.S. PATENT DOCUMENTS

| | | | |
|---|---|---|---|
| 2,521,761 | 9/1950 | Strawinski | 195/3 |
| 2,574,070 | 11/1951 | Strawinski | 195/3 |
| 2,641,564 | 6/1953 | Zobell | 435/282 |
| 2,975,103 | 3/1961 | Kirshenbaum | 435/282 |
| 3,069,325 | 12/1962 | Hitzman | 195/3 |
| 3,305,353 | 2/1967 | Duncan et al. | 75/101 |
| 4,206,288 | 6/1980 | Detz et al. | 435/267 |
| 4,283,270 | 8/1981 | McHale | 208/50 |
| 4,562,156 | 12/1985 | Isbister et al. | 435/253 |
| 4,618,348 | 10/1986 | Hayes et al. | 44/51 |
| 4,632,906 | 12/1986 | Kopacz | 435/282 |
| 4,659,670 | 4/1987 | Stevens, Jr. et al. | 435/262 |
| 4,703,010 | 10/1987 | Yunker et al. | 435/173 |
| 4,808,535 | 2/1989 | Isbister | 435/252.1 |
| 4,851,350 | 7/1989 | Stevens, Jr. et al. | 435/262 |
| 4,861,723 | 8/1989 | Madgavkar | 435/262 |
| 4,954,229 | 9/1990 | Kim et al. | 204/130 |
| 5,002,888 | 3/1991 | Kilbane | 435/252.31 |
| 5,094,668 | 3/1992 | Kern et al. | 44/622 |
| 5,104,801 | 4/1992 | Kilbane | 435/282 |
| 5,132,219 | 7/1992 | Kilbane | 435/195 |
| 5,198,341 | 3/1993 | Kilbane | 435/42 |
| 5,232,854 | 8/1993 | Monticello | 435/282 |

FOREIGN PATENT DOCUMENTS

| | | | |
|---|---|---|---|
| 147365 | 1/1981 | Germany | 435/282 |
| 9209706 | 6/1992 | WIPO | 435/282 |

OTHER PUBLICATIONS

Gary, James H. and Handwerk, Glenn E., "Hydrotreating," in *Petroleum Refining Technology and Economics* (NY: Marcel Dekker, Inc.), pp. 114–120 (1975).

(List continued on next page.)

*Primary Examiner*—Michael G. Wityshyn
*Assistant Examiner*—Timothy J. Reardon
*Attorney, Agent, or Firm*—Hamilton, Brook, Smith & Reynolds

[57] ABSTRACT

A method of deeply desulfurizing a fossil fuel which contains a variety of organic sulfur compounds, some of which are labile to hydrodesulfurization (HDS) and some of which are refractory to HDS, comprising the steps of (a) subjecting the fossil fuel to HDS or a similar method of desulfurizing labile organic sulfur compounds, and b) subjecting the fossil fuel to biocatalytic desulfurization (BDS) using a biocatalyst which is capable of selectively liberating sulfur from HDS-refractory organic sulfur compounds. In this manner, a fossil fuel is produced which does not generate sufficient levels of hazardous, sulfur-containing combustion products that it requires post-combustion desulfurization when it is burned. Moreover, the deeply desulfurized fossil fuel can be produced using only a mild HDS treatment, rather than requiring conditions which may be severe enough to be detrimental to the fuel value of the desired product. The biocatalyst employed in the BDS stage of the instant invention is capable of catalyzing the sulfur-specific, oxidative cleavage of organic carbon-sulfur bonds in sulfur-bearing aromatic heterocyclic molecules such as dibenzothiophene. A particularly preferred biocatalyst is a culture of Rhodococcus rhodocrous bacteria, ATCC No. 53968 or its active lysate, extract, fraction or subfraction.

9 Claims, 3 Drawing Sheets

OTHER PUBLICATIONS

Speight, J. G. "The Hydrodesulfurization Process," in *The Desulfurization of Heavy Oils and Residue* (NY: Marcel Dekker, Inc.), pp. 119–127 (1981).

Gundlach, E. R. et al., "The Fate of Amoco Cadiz Oil" Science, 221:122–129 (1983).

Hartdegen, F. J. et al., "Microbial Desulfurization of Petroleum," *Chem. Eng. Progress 80* (5):63–67, (1984).

Monticello, D. J. and Finnerty, W. R., "Microbial Desulfurization of Fossil Fuels," *Ann Rev. Microbiol.* 39:371–389 (1985).

Shih, S. S. et al., "Deep Desulfurization of Distillate Components," Paper presented at the 1990 AIChE Chicago Annual Meeting, Session #264, (Paper 264B) Chicago, Ill. (1990, Nov.).

Kilbane, John J. II, "Sulfur–Specific Microbial Metabolism of Organic Compounds," *Resources, Conservation and Recycling* 3:69–79 (1990).

Monticello, Daniel J. and Kilbane, John J., "Practical Considerations in Biodesulfurization of Petroleum," presented at IGT's Third International Symposium on Gas, Oil, Coal and Environmental Biotechnology, New Orleans, La., (1990, Dec.).

Lee, K–I. et al., "Sulfur Removal from Coal Through Multiphase Media Containing Biocatalysts," *J. Chem. Tech. Biotecchnol.* 48:71–79, (1990).

Kilbane, J. J. "Desulfurization of coal: the microbial solution," *Trends in Biotechnology 7* (4):97–101, (1989).

Kargi, Fikret and Robinson, James M., "Microbial Oxidation of Dibenzothiophene by the Thermophilic Organism Sulfolobus acidocaldarius," *Biotechnology and Bioengineering* 26:687–690 (1984).

Isbister, J. D. and Kobylinski, E. A., "Microbial Desulfurization of Coal," presented at The First International Conference on Processing and Utilization of High Sulfur Coals, Columbus, Ohio (1985, Oct.).

Kilbane, J. J., "Biodesulfurization: Future Prospects in Coal Cleaning," presented at Seventh Annual International Pittsburgh Coal Conference, Pittsburgh, Pa. (1990, Sep.).

Kilbane, J. J., "Biodesulfurization of Coal," presented at the IGT Symposium On Gas, Oil and Coal Biotechnology, New Orleans, La., (1988, Dec.).

MULTISTAGE PROCESS FOR DEEP DESULFURIZATION OF FOSSIL FUELS

RELATED APPLICATIONS

The following is a continuation-in-part of copending U.S. Ser. No. 07/669,914, filed Mar. 15, 1991, now U.S. Pat. No. 5,232,854 the teachings of which are hereby incorporated by reference.

BACKGROUND

Sulfur is an objectionable element which is nearly ubiquitous in fossil fuels, where it occurs as both inorganic sulfur (mineralized as in iron pyrite) and organic sulfur (covalently bound to carbonaceous molecules). The presence of sulfur has been correlated with corrosion of pipeline, pumping, and refining equipment, and with premature breakdown of combustion engines. Sulfur also contaminates or poisons many catalysts which are used in the refining and combustion of fossil fuels. Moreover, the atmospheric emission of sulfur combustion products such as sulfur dioxide leads to the form of acid deposition known as acid rain. Acid rain has lasting deleterious effects on aquatic and forest ecosystems, as well as on agricultural areas located downwind of combustion facilities. Monticello and Finnerty (1985), 39 ANN. REV. MICROBIOL. 371–389. Regulations such as the Clean Air Act of 1964 require the removal of sulfur, either pre- or post-combustion, from virtually all fossil fuels. Conformity with such legislation has become increasingly problematic due to the rising need to utilize lower-grade, higher-sulfur fossil fuels as clean-burning, low-sulfur petroleum reserves become depleted, as well as the progressively more stringent reductions in sulfur emissions required by regulatory authorities. Monticello and Kilbane (1990), *Practical considerations in biodesulfurization of petroleum*, IGT's 3RD INTL. SYMP. ON GAS, OIL, COAL, AND ENV. BIOTECHNOL., New Orleans, La.

There are several well-known physicochemical methods for depleting the sulfur content of fossil fuels prior to combustion. One method that is widely-used for the removal of organic sulfur is hydrodesulfurization (HDS). In HDS, the fossil fuel is contacted with hydrogen gas at elevated temperature and pressure, in the presence of a catalyst. Organic sulfur is removed by the reductive conversion of sulfur bound to carbonaceous molecules to $H_2S$, a corrosive gaseous product which is separated from the treated fuel by stripping. As with other desulfurization techniques, HDS is not equally effective in removing all forms of sulfur found in fossil fuels. Gary and Handwerk (1975), *PETROLEUM REFINING: TECHNOLOGY AND ECONOMICS* (Marcel Dekker, Inc., publ.) 114–120.

For example, HDS is not particularly effective for the desulfurization of coal, wherein inorganic sulfur, especially pyritic sulfur, can constitute 50% or more of the total sulfur content, the remainder being various forms of organic sulfur. The total sulfur content of coal can typically be close to about 10 wt % or it can be as low as about 0.2 wt %, depending on the geographic location of the coal source. Pyritic sulfur is not efficaciously removed by HDS. Thus, only a fraction of the total sulfur content of coal is susceptible to removal by HDS.

HDS is relatively more suitable for desulfurizing petroleum, such as crude oil or refining intermediates thereof, as organic sulfur can account for close to 100% of the sulfur content of these fossil fuels. Crude oils can typically range from close to about 5 wt % down to about 0.1 wt % organic sulfur; crude oils obtained from the Persian Gulf area and from Venezuela can be particularly high in sulfur content. Monticello and Kilbane (1990), *Practical considerations in biodesulfurization of petroleum,* IGT's 3RD INTL. SYMP. ON GAS, OIL, COAL, AND ENV. BIOTECHNOL., New Orleans, La., and Monticello and Finnerty (1985), 39 ANN. REV. MICROBIOL. 371–389.

Organic sulfur in both coal and petroleum fossil fuels is present in a myriad of compounds, some of which are termed labile in that they can readily be desulfurized, others of which are termed refractory in that they do not easily yield to conventional desulfurization treatment, e.g., by HDS. Shih, S. S. et al. (1990), AIChE Abstract No. 264B (complete text available upon request from the American Institute of Chemical Engineers); hereinafter Shih et al. Thus, even HDS-treated fossil fuels must be post-combustively desulfurized using an apparatus such as a flue scrubber. Flue scrubbers are expensive to install and difficult to maintain, especially for small combustion facilities. Moreover, of the sulfur-generated problems noted above, the use of flue scrubbers in conjunction with HDS is directed to addressing environmental acid deposition, rather than other sulfur-associated problems, such as corrosion of machinery and poisoning of catalysts.

Mercaptans, thioethers, and disulfides exemplify classes of sulfur-containing carbonaceous molecules that are labile to desulfurizing treatments such as HDS. Aromatic carbonaceous molecules, especially those in which sulfur is bonded to the hydrocarbon matrix in aromatic bonds, are refractory to desulfurization by conventional means, e.g., HDS. Such refractory molecules typically require desulfurization conditions harsh enough to degrade valuable hydrocarbons in the fossil fuel. Shih et al. Hence, refractory organic sulfur molecules account for a large proportion of the residual sulfur present in many combustible fuel products.

The foregoing limitations to conventional desulfurization methods such as HDS have spurred considerable and longstanding interest among those engaged in the extraction and refining of fossil fuels in developing commercially viable techniques of microbial desulfurization (MDS). MDS is generally described as the harnessing of metabolic processes of suitable bacteria to the desulfurization of fossil fuels. MDS typically involves mild (e.g., ambient) conditions, and does not involve the extremes of temperature and pressure required for HDS. Several species of chemolithotrophic bacteria have been investigated in connection with MDS development, due to their abilities to consume (catabolize) forms of sulfur that are generally found in fossil fuels. For example, species such as *Thiobacillus ferrooxidans* are capable of extracting energy from the conversion of pyritic sulfur to water-soluble sulfate. Such bacteria are envisioned as being well-suited to the desulfurization of coal.

Other species, e.g., *Pseudomonas putida,* are capable of consuming organic sulfur molecules, converting them into water-soluble sulfur products. However, this process is merely incident to the utilization of the hydrocarbon portion of these molecules as a carbon source: valuable combustible hydrocarbons are lost. Moreover, MDS processes based on the use of these microorganisms most readily desulfurizes the same classes of organic sulfur molecules as are labile to HDS. Thus, although MDS does not involve exposing fossil fuels to the extreme conditions encountered in HDS, a significant amount of the fuel value of the coal or liquid petroleum so treated is lost, and the resultant fuel product often still requires post-combustion desulfurization. Microbial desulfurization technology is reviewed in Monticello and Finnerty (1985), 39 ANN. REV. MICROBIOL. 371–389 and Bhadra et al. (1987), 5 BIOTECH. ADV. 1–27. Hartdegan et al. (1984), 5 CHEM. ENG. PROGRESS 63–67 and Kilbane (1989), 7 TRENDS BIOTECHNOL. (NO. 4) 97–101 provide additional commentary on developments in the field.

A need remains to develop more effective methods for pre-combustion desulfurization. This need grows progressively more urgent as lower-grade, higher-sulfur fossil fuels are increasingly used, while concurrently the sulfur emissions standards set by regulatory authorities become ever more stringent.

SUMMARY OF THE INVENTION

This invention relates to a multistage process for producing a deeply desulfurized liquid fossil fuel. A deeply desulfurized liquid fossil fuel is suitable for combustion without post-combustion desulfurization. An example of a deeply desulfurized liquid fossil fuel is one having a total residual sulfur content below about 0.05 wt %. Deeply desulfurized, clean burning liquid fossil fuels can be produced, using the present multistage deep desulfurization method, from petroleum (e.g., crude oil), petroleum refining intermediates (e.g., middle distillates), refined petroleum (e.g., diesel oil), and coal-derived liquids. In many instances, deeply desulfurized fossil fuels cannot be produced from these materials using currently available technology. Thus, the present invention significantly advances the state of the art in that it greatly expands the range of fossil fuels which can be deeply desulfurized and thereby converted into clean burning fuel products.

The method disclosed herein is carried out in two stages. In one stage, a liquid fossil fuel containing organic sulfur, said organic sulfur comprising aromatic sulfur-bearing heterocycles, is subjected to either hydrodesulfurization (HDS) or microbial desulfurization (MDS). MDS treatment can be carried out with one or more microorganisms of the type that consume and thereby desulfurize the types of organic sulfur molecules that are labile to HDS, or with one or more microorganisms of the type that extract energy from pyritic sulfur, or with a mixture of these types of microorganisms. In this manner, the liquid fossil fuel is depleted of forms of organic sulfur susceptible to removal by HDS or MDS but is not substantially depleted of aromatic sulfur-bearing heterocycles.

In the other stage of the present process, the liquid fossil fuel containing aromatic sulfur-bearing heterocycles is subjected to biocatalytic desulfurization (BDS). BDS treatment comprises the steps of: (i) contacting the liquid fossil fuel with an effective amount of a biocatalyst that catalyzes the removal of sulfur from aromatic sulfur-bearing heterocycles, such that desulfurized organic molecules and inorganic sulfur are produced therefrom; (ii) incubating the liquid fossil fuel with the biocatalyst under conditions sufficient for the removal of sulfur from aromatic sulfur-bearing heterocycles by said biocatalyst, whereby desulfurized organic molecules and inorganic sulfur are produced; and (iii) separating the desulfurized organic molecules from the inorganic sulfur produced during incubation with the biocatalyst. BDS treatment can be carried out either before or after conventional desulfurization treatment with HDS or MDS.

The two stages of the present treatment can be carried out in immediate succession, or with an interval of time between the stages of treatment. By combining conventional (e.g., HDS) and BDS treatments into a multistage process, the present invention is sufficient to produce a liquid fossil fuel suitable for combustion without resort to post-combustion desulfurization techniques. A significant advantage of the present invention is that this result is accomplished by the removal of sulfur from a large and diverse array of the forms in which sulfur occurs in liquid fossil fuels, including inorganic and organic sulfur. Most significantly, organic sulfur is removed from a broad range of organic sulfur compounds, including compounds that are refractory to HDS and similar treatments as well as compounds that are labile to HDS. Thus, the stages of desulfurization treatment in the present invention combine synergistically to produce a deeply desulfurized fuel product. This is accomplished without the need to remove and discard refining fractions that are high in refractory organic sulfur molecules. Thus, through implementation of the present invention, certain refining fractions that would otherwise be viewed as waste or as having limited utility can be recovered and used for the manufacture of deeply desulfurized, clean burning fuels.

In many embodiments, the liquid fossil fuel is subjected to HDS treatment either before or after BDS treatment. Indeed, this flexibility is one of the hallmarks of the present invention. The multistage deep desulfurization process described herein can be readily integrated into current fossil fuel refining practices and facilities. The stages of the present invention can be carried out in a manner most advantageous to the needs of a particular refining facility. Depending on the layout of the facility, available unit operations, products generated, and source of the liquid fossil fuel (among other considerations), it may be advantageous to first subject the liquid fossil fuel to HDS, and then to BDS. Conversely, the specifications of the product(s) being generated may be best met by following biocatalytic desulfurization with a mild hydrotreating polishing step. This can ensure, for instance, that any aqueous traces (which are cosmetically undesirable, as residual water can produce cloudiness) are removed from the fuel product. In this manner it is possible to either treat the unfractionated liquid fossil fuel at an early stage in the refining process, or to selectively treat only those fractions for which desulfurization is most problematic.

Preferably, the biocatalyst employed for BDS treatment removes sulfur from aromatic sulfur-bearing heterocycles by a sulfur-specific cleavage reaction. In such embodiments, the biocatalyst is a preparation comprising one or more microorganisms that catalyze the removal of sulfur from aromatic sulfur-bearing heterocycles, such that desulfurized organic molecules and inorganic sulfur are produced therefrom, enzymes obtained from such microorganisms, or mixtures of such microorganisms and enzymes. Suitable biocatalysts specifically cleave sulfur from sulfur-bearing heterocycles oxidatively or reductively. If an oxidative biocatalyst is used, it may be desirable to increase oxygen tension in the liquid fossil fuel by supplementation from an external source. Thus, the present invention optionally encompasses the additional step of contacting the liquid fossil fuel with a source of oxygen prior to incubation with the biocatalyst, such that oxygen tension therein is increased.

The Rhodococcus Sp. bacteria available from the American Type Culture Collection as ATCC No. 53968, along with mutational and engineered derivatives thereof, exemplify the class of microorganisms that are suitable for use as the BDS biocatalyst or as the source of said biocatalyst for use in the present invention. Thus, one suitable biocatalyst preparation for use herein is a culture of Rhodococcus Sp. bacteria, ATCC No. 53968. Other suitable biocatalysts include substantially cell-free preparations of one or more enzymes obtained from Rhodococcus Sp. bacteria, ATCC No. 53968 or a derivative thereof. For example, a preparation such as a lysate, fraction, extract or purified product obtained by conventional means from suitable bacteria and having therein suitable enzymatic activity can be used as the biocatalyst for BDS treatment in the present invention.

DETAILED DESCRIPTION OF PREFERRED EMBODIMENTS

In the petroleum extraction and refining arts, the term "organic sulfur" is generally understood as referring to organic molecules having a hydrocarbon framework to which one or more sulfur atoms (called heteroatoms) are covalently joined. These sulfur atoms can be joined directly to the hydrocarbon framework, e.g., by one or more carbon-sulfur bonds, or can be present in a substituent joined to the hydrocarbon framework of the molecule, e.g., a sulfonyl group (which contains a carbon-oxygen-sulfur covalent linkage). The general class of organic molecules having one or more sulfur heteroatoms are sometimes referred to as "organosulfur compounds". The hydrocarbon portion of these compounds can be aliphatic, aromatic, or partially aliphatic and partially aromatic.

Cyclic or condensed multicyclic organosulfur compounds in which one or more sulfur heteroatoms are linked to adjacent carbon atoms in the hydrocarbon framework by aromatic carbon-sulfur bonds are referred to as "sulfur-bearing heterocycles". The sulfur that is present in many types of sulfur-bearing heterocycles is referred to as "thiophenic sulfur" in view of the five-membered aromatic ring in which the sulfur heteroatom is present. The simplest such sulfur-bearing heterocycle is thiophene, which has the composition $C_4H_4S$.

Sulfur-bearing heterocycles are known to be stable to conventional desulfurization treatments, such as HDS. For this reason, they are said to be refractory or recalcitrant to HDS treatment. Sulfur-bearing heterocycles can have relatively simple or relatively complex chemical structures. In complex heterocycles, multiple condensed aromatic rings, one or more of which can be heterocyclic, are present. The difficulty of desulfurization increases with the structural complexity of the molecule. Shih et al. That is, refractory behavior is most accentuated in complex sulfur-bearing heterocycles, such as dibenzothiophene (DBT, $C_{12}H_8S$).

Figure 1A:
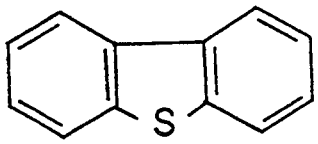
FIGS. 1A–1D depict the chemical structure of a model sulfur-bearing heterocycle, dibenzothiophene (DBT, compound a), along with the chemical structures of molecules produced from DBT upon biocatalytic desulfurization according to the present invention. Reductive biocatalysts convert DBT into biphenyl (compound b) under anaerobic conditions. Oxidative biocatalysts convert DBT into hydroxybiphenyl (compound c), dihydroxybiphenyl (compound d) or a mixture thereof.
Figure 1B:
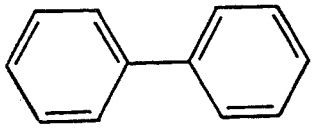

DBT is a sulfur-bearing heterocycle that has a condensed, multiple aromatic ring structure in which a five-membered thiophenic ring is flanked by two six-membered benzylic rings, as shown in FIG. 1A. Much of the residual post-HDS organic sulfur in fossil fuel refining intermediates and combustible products is thiophenic sulfur. The majority of this residual thiophenic sulfur is present in DBT and derivatives thereof having one or more alkyl or aryl radicals attached to one or more carbon atoms present in one or both flanking benzylic rings. Such DBT derivatives are said to be "decorated" with these radicals. DBT itself is accepted in the relevant arts as a model compound illustrative of the behavior of the class of compounds encompassing DBT and alkyl- and/or aryl-decorated derivatives thereof in reactions involving thiophenic sulfur. Monticello and Finnerty (1985), *Microbial desulfurization of fossil fuels,* 39 ANNUAL REVIEWS IN MICROBIOLOGY 371-389, at 372-373. DBT and radical-decorated derivatives thereof can account for a significant percentage of the total sulfur content of particular crude oils, coals and bitumen. For example, these sulfur-bearing heterocycles have been reported to account for as much as 70 wt % of the total sulfur content of West Texas crude oil, and up to 40 wt % of the total sulfur content of some Middle East crude oils. Thus, DBT is considered to be particularly relevant as a model compound for the forms of thiophenic sulfur found in fossil fuels, such as crude oils, coals or bitumen of particular geographic origin, and various refining intermediates and fuel products manufactured therefrom. Id. Another characteristic of DBT and radical-decorated derivatives thereof is that, following a release of fossil fuel into the environment, these sulfur-bearing heterocycles persist for long periods of time without significant biodegradation. Gundlach et al. (1983), 221 SCIENCE 122–129. Thus, most prevalent naturally occurring microorganisms do not effectively metabolize and break down sulfur-bearing heterocycles.

A liquid fossil fuel that is suitable for multistage deep desulfurization treatment according to the present invention is one that contains organic sulfur. Such a fossil fuel is referred to as a "substrate fossil fuel". Substrate fossil fuels that are rich in thiophenic sulfur (wherein a significant fraction of the total organic sulfur is thiophenic sulfur, present in sulfur-bearing heterocycles) are particularly suitable for desulfurization according to the process described herein. Examples of such substrate fossil fuels include Cerro Negro or Orinoco heavy crude oils; Athabascan tar and other types of bitumen; petroleum refining fractions such as light cycle oil, heavy atmospheric gas oil, and No. 1 diesel oil; and coal-derived liquids manufactured from sources such as Pocahontas #3, Lewis-Stock, Australian Glencoe or Wyodak coal.

As a result of treatment according to the present multistage deep desulfurization process, the organic sulfur content of the substrate fossil fuel is sufficiently reduced to allow the treated fuel to be burned without the need for post-combustion desulfurization. When burned, the treated fuel does not generate sulfur-containing combustion products in amounts that are so high as to be considered harmful to the environment. Such a fuel is referred to herein as a "deeply desulfurized liquid fossil fuel." One example of a deeply desulfurized liquid fossil fuel is one having a total residual sulfur content below about 0.05 wt %. Shih et al. Deeply desulfurized liquid fossil fuels produced as described herein can optionally be subjected to one or more further refining or polishing steps according to conventional techniques.

As summarized above, the present multistage method synergistically combines desulfurizing treatments which complement each other, in that each accomplishes the removal of sulfur from different classes of structurally and chemically diverse sulfur compounds. A deeply desulfurized fossil fuel produced according to the present invention is one in which sulfur has been removed from a wide spectrum of sulfur compounds. In a first stage, a substrate fossil fuel is subjected to treatment sufficient to remove sulfur from labile organosulfur compounds and/or from inorganic sulfur compounds. In a second stage, the substrate fossil fuel is subjected to biocatalytic desulfurizing treatment sufficient to remove sulfur from refractory organosulfur compounds, such as sulfur-bearing heterocycles.

In many embodiments of the present invention, the first stage of multistage deep desulfurization is carried out by subjecting a substrate fossil fuel to HDS. HDS is a well-known physicochemical desulfurization technique, which involves reacting a liquid, sulfur-containing fossil fuel with hydrogen gas in the presence of a catalyst, under conditions of elevated temperature and pressure. Suitable catalysts include cobalt-aluminum oxides, molybdenum-aluminum oxides, or combinations thereof. HDS is more particularly described in Shih et al., Gary and Handwerk (1975), PETROLEUM REFINING: TECHNOLOGY AND ECONOMICS 114–120 (Marcel Dekker, Inc., publ.), and Speight (1981), THE DESULFURIZATION OF HEAVY OILS AND RESIDUE 119–127 (Marcel Dekker, Inc., publ.). As noted previously, thiophenic sulfur, as found in sulfur-bearing heterocycles, accounts for a substantial proportion of the residual organic sulfur which remains following standard HDS treatment. As substrate fossil fuels are depleted of labile organosulfur compounds, sulfur-bearing heterocycles account for greater proportions of the total remaining organic sulfur content. For example, sulfur-bearing heterocycles such as DBT and radical-decorated derivatives thereof can account for as much as two-thirds of the total residual sulfur in No. 2 fuel oil. These refractory organosulfur compounds cannot be removed from the substrate fossil fuel even by repeated HDS processing under increasingly severe conditions. Shih et al.

In other embodiments of the present invention, the first stage of deep desulfurization is carried out by subjecting the fossil fuel to MDS using one or more microorganisms that do not effectively desulfurize sulfur-bearing heterocycles, but are suitable for removing sulfur from other types of sulfur compounds present in the fossil fuel. For example, microorganisms of the genus Thiobacillus can be used to remove pyritic sulfur from a coal-derived liquid as taught by Madgavkar in U.S. Pat. No. 4,861,723 (issued 1989). Alternatively, one or more microorganisms, e.g., *Thiophyso volutans, thiobacillus thiooxidans,* or *thiobacillus thioparus,* can be used to catabolize labile organosulfur compounds present in petroleum liquids as taught by Kirshenbaum in U.S. Pat. No. 2,975,103 (issued 1961).

In the other stage of multistage deep desulfurization, a substrate fossil fuel containing sulfur-bearing heterocycles is subjected to biocatalytic desulfurization (biocatalysis or BDS). BDS is the excision (liberation or removal) of sulfur from refractory organosulfur compounds, including sulfur-bearing heterocycles, as a result of the selective cleavage of carbon-sulfur bonds in said compounds by a biocatalyst. The selective biocatalytic cleavage of carbon-sulfur bonds in BDS can follow an oxidative pathway or a reductive pathway. In many embodiments contemplated herein, BDS is an oxidative process. BDS treatment yields the desulfurized combustible hydrocarbon framework of the former refractory organosulfur compound, along with inorganic sulfur—substances which can be readily separated from each other by known techniques such as frational distillation or water extraction.

BDS is carried out by a biocatalyst comprising one or more microorganisms that functionally express one or more enzymes that direct, singly or in concert with each other, the removal of sulfur from organosulfur compounds, including sulfur-bearing heterocycles, by the selective cleavage of carbon-sulfur bonds, whether or not said bonds are aromatic, in said compounds; one or more enzymes obtained from such microorganisms; or a mixture of such microorganisms and enzymes.

Figure 1C:
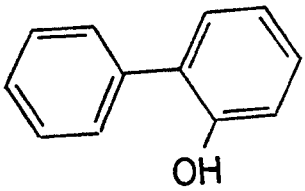

Oxidative (aerobic) biocatalysts convert DBT FIG. 1A into hydroxybiphenyl (FIG. 1C), dihydroxybiphenyl (FIG. 1D) or a mixture thereof. A preferred microorganism that can be used as an oxidative biocatalyst, or as the source of an oxidative enzyme biocatalyst, is the strain of Rhodococcus sp. disclosed by Kilbane in U.S. Pat. No. 5,104,801 (issued Apr. 14, 1992), further described in Kilbane (1990), Biodesulfurization: future prospects in coal cleaning, in PROC, 7TH ANN. INT'L. PITTSBURGH COAL CONF. 373–382, and available from the American Type Culture Collection, 12301 Park Lawn Drive, Rockville, Md., U.S.A. 20852, under the terms of the Budapest Treaty as ATCC Deposit No. 53968. Thus, one suitable ATCC No. 53968 biocatalyst preparation for use herein is a culture of the living microorganisms, prepared generally as described in U.S. Pat. No. 5,104,801 and in prior U.S. patent application, Ser. No. 07/669,914, now U.S. Pat. No. 5,232,854. The strain of *Bacillus sulfasportare* disclosed by Kilbane in U.S. Pat. Nos. 5,002,888 (issued Mar. 26, 1991) and 5,198,341 (issued Mar. 30, 1993) and available from the American Type Culture Collection as ATCC Deposit No. 53969 can be used similarly, as can the microorganism described in Omori et al. (1992), Desulfurization of dibenzothiophene by *Corynebacterium* sp. strain SY1, 58 APPL. ENV. MICROBIOL. (No. 3) 911–915.

Figure 1D:
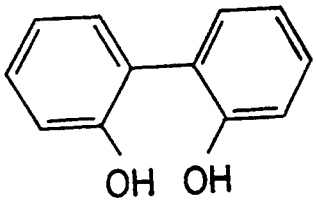

Preferred oxidative biocatalysts suitable for use herein selectively liberate thiophenic sulfur from sulfur-bearing heterocycles such as DBT by the sequential addition of oxygen atoms to the sulfur heteroatom, culminating in oxidative cleavage of the aromatic carbon-sulfur bonds by which the thiophenic sulfur heteroatom is joined to the hydrocarbon framework of the sulfur-bearing heterocycle. The strain of Rhodococcus Sp. bacteria, ATCC No. 53968, disclosed by Kilbane in U.S. Pat. No. 5,104,801 is representative of the unique class of biocatalysts that function in this manner. The selective oxidative excision of sulfur from DBT has been thought to proceed by the published "4S" pathway, so named to designate its sulfur-containing intermediates (DBT-sulfoxide, DBT-sulfone and DBT-sulfonate) and product (inorganic sulfate) . Kilbane (1990) , Sulfur-specific microbial metabolism of organic compounds, 3 RESOUR. CONSERV. RECYCL. 69–79. According to the published 4S pathway, the hydrocarbon product of the representative compound DBT is 2,2'-dihydroxybiphenyl (FIG. 1D). Id. at 74. It should be noted, however, that the ATCC No. 53968 microorganism converts DBT into 2-hydroxybiphenyl (2-HBP, FIG. 1C); thus, it desulfurizes organosulfur compounds by an oxidative biocatalytic pathway that differs subtly from the published "4S" pathway. See Kilbane (1990), 3 RESOUR. CONSERV. RECYCL. at Table 2, p. 75.

Reductive biocatalysts suitable for use herein convert DBT into biphenyl (compound b of FIG. 1). The microorganism disclosed in Kim et al. (1990), Degradation of organic sulfur compounds and the reduction of dibenzothiophene to biphenyl and hydrogen sulfide by *Desulfovibrio desulfuricans* M6, 12 BIOTECH. LETT. (NO. 10) 761–764 functions in this manner, and can thus be used as a reductive (anaerobic) biocatalyst or biocatalyst source.

Each of the foregoing microorganisms can function as a biocatalyst in the present invention because each produces one or more enzymes (protein biocatalysts) that carry out the specific chemical reaction(s) by which sulfur is excised from refractory organosulfur compounds. Lehninger, PRINCIPLES OF BIOCHEMISTRY (Worth Publishers, Inc., 1982), p. 8–9; cf. Zobell in U.S. Pat. No. 2,641,564 (issued Jun. 9, 1953) and Kern et al. in U.S. Pat. No. 5,094,668 (issued Mar. 10, 1992). Mutational or genetically engineered derivatives of any of the foregoing microorganisms can also be used as the biocatalyst herein, provided that appropriate biocatalytic function is retained.

Additional microorganisms suitable for use as the BDS biocatalyst or biocatalyst source in the multistage deep desulfurization process now described can be derived from naturally occurring microorganisms by known techniques. These methods involve culturing preparations of microorganisms obtained from natural sources such as sewage sludge, petroleum refinery wastewater, garden soil, or coal tar-contaminated soil under selective culture conditions in which the microorganisms are grown in the presence of refractory organosulfur compounds such as sulfur-bearing heterocycles as the sole sulfur source; exposing the microbial preparation to chemical or physical mutagens; or a combination of these methods. Such techniques are recounted by Isbister and Doyle in U.S. Pat. No. 4,562,156 (issued Dec. 31, 1985); by Kilbane in 3 RESOUR. CONSERV. RECYCL. 69–79 (1990), U.S. Pat. Nos. 5,002,888, 5,104,801 and 5,198,341; and by Omori and coworkers in 58 APPL. ENV. MICROBIOL. (No. 3) 911–915 (1992).

As explained above, enzymes are protein biocatalysts made by living cells. Enzymes promote, direct or facilitate the occurrence of a specific chemical reaction or series of reactions (referred to as a pathway) without themselves becoming consumed or altered as a result thereof. Enzymes can include one or more unmodified or post-translationally or synthetically modified polypeptide chains or fragments or portions thereof, coenzymes, cofactors, or coreactants which collectively carry out the desired reaction or series of reactions. The reaction or series of reactions relevant to the present invention culminates in the excision of sulfur from the hydrocarbon framework of a refractory organosulfur compound, such as a sulfur-bearing heterocycle. The hydrocarbon framework of the former refractory organosulfur compound remains substantially intact. Microorganisms or enzymes employed as biocatalysts in the present invention advantageously do not consume the hydrocarbon framework of the former refractory organosulfur compound as a carbon source for growth. As a result, the fuel value of substrate fossil fuels exposed to BDS treatment does not deteriorate.

Although living microorganisms (e.g., a culture) can be used as the biocatalyst herein, this is not required. In certain suitable microorganisms, including Rhodococcus sp. ATCC No. 53968, the enzyme responsible for biocatalytic cleavage of carbon-sulfur bonds is present on the exterior surface (the cell envelope) of the intact microorganism. Thus, non-viable (e.g., heat-killed) microorganisms can be used as a carrier for an enzyme biocatalyst. Other biocatalytic enzyme preparations that are useful in the present invention include microbial lysates, extracts, fractions, subfractions, or purified products obtained by conventional means and capable of carrying out the desired biocatalytic function. Generally, such enzyme preparations are substantially free of intact microbial cells. Kilbane and Monticello disclose enzyme preparations that are suitable for use herein in U.S. Pat. No. 5,132,219 (issued Jul. 21, 1992), and in pending U.S. patent application Ser. No. 07/897,314 (filed Jun. 11, 1992), now allowed. Rambosek et al. disclose additional enzyme preparations, engineered from Rhodococcus Sp. ATCC No. 53968 and suitable for use herein, in U.S. patent application Ser. No. 07/911,845. (filed Jul. 10, 1992, now abandoned). Enzyme biocatalyst preparations suitable for use herein can optionally be affixed to a solid support, e.g., a membrane, filter, polymeric resin, glass particles or beads, or ceramic particles or beads. The use of immobilized enzyme preparations facilitates the separation of the biocatalyst from the treated fossil fuel which has been depleted of refractory organosulfur compounds.

It is preferable to prepare a BDS-active suspension of lysed microorganisms, substantially free of intact cells. Any lysis process, whether conventional or adapted from conventional techniques, can be used, provided that the enzyme responsible for BDS reactivity remains functional. For example, the ATCC No. 53968 bacteria can be subjected to one or more freeze-thaw cycles, treated with a suitable detergent and/or chaotropic agent, processed using a French press, or, more preferably, can be sonicated by conventional means comprising the use of a bath or immersion probe sonicator and incubation on melting ice.

It is particularly preferred to prepare a substantially cell-free aqueous extract of the microbial source of BDS reactivity, wherein the extract contains a substantial proportion of the total BDS activity functionally expressed by the microorganism. In certain suitable microorganisms, the BDS reactive enzyme may be functionally expressed as a cell envelope-associated enzyme. In the case of the ATCC No. 53968 microorganism and its functional derivatives, it was previously disclosed in U.S. Ser. No. 07/486,597, now U.S. Pat. No. 5,132,219 that BDS activity appears to arise from an enzyme associated with the exterior cell membrane and/or cell wall of the intact bacterium.

A cell free extract suitable for use as biocatalyst in the present BDS method can be prepared according to standard techniques, such as centrifugal fractionation, ammonium sulfate fractionation, filtration, bioaffinity or immunoaffinity precipitation, gel permeation chromatography, liquid chromatography, high pressure liquid chromatography, reverse-phase liquid chromatography, preparative electrophoresis, isoelectric focussing, and the like. For example, a centrifugal fractionation procedure, wherein it is shown that a substantial proportion of ATCC No. 53968 expressed BDS reactivity is associated with the "cell debris" fraction of sonicated, lysed bacterial cells. This fraction, which comprises fragments of cell walls and/or outer cell membranes, was obtained as a pellet following centrifugation of lysed ATCC No. 53968 cells for 5 minutes at 6,000 xg.

In another embodiment, recombinant enzymes can be employed. These enzymes can be prepared by methods known in the art, such as by complementation, as exemplified below.

Mutant strains of a *R. rhodochrous,* which are incapable of cleaving carbon-sulfur bonds, are produced by exposing a strain of *R. rhodochrous* to a mutagen to produce *R. rhodochrous* mutants. Suitable strains of *R. rhodochrous* include any strain of *R. rhodochrous* containing DNA which encodes a biocatalyst capable of selective cleavage of carbon-sulfur bonds, such as ATCC No. 53968 as reported in U.S. Pat. No. 5,104,801, the teachings of which are incorporated herein by reference. In one embodiment, the IGTS8 strain of *R. rhodochrous,* from Institute of Gas Technology (Chicago, Ill.) is used.

Suitable mutagens include radiation, such as ultraviolet radiation or chemical mutagens, such as N-methyl-N'-nitrosoguanidine (NTG), hydroxylamine, ethylmethanesulphonate (EMS) and nitrous acid.

*R. rhodochrous* mutants are allowed to grow in an appropriate medium and screened for carbon-sulfur bond cleavage activity. Mutants without carbon-sulfur bond cleavage activity are labelled CS−. Any method of screening which allows for an accurate detection of carbon-sulfur bond cleavage activity is suitable in the method of the present invention. Suitable methods of screening for this activity include exposing the different mutants to carbon-sulfur bond containing molecules and measure carbon-sulfur bond cleavage. In a preferred embodiment, the mutants are exposed to DBT, whose breakdown product, 2-hydroxybiphenyl (2-HBP), fluoresces under short wave ultraviolet light. Other methods include gas and liquid chromatography, infrared and nuclear magnetic resonance spectra. See Kodama, et al., Applied and Environmental Microbiology, pages 911–915 (1992) and Kilbane and Bielaga, Final Report D.O.E. Contract No. DE-AC22-88PC8891 (1991). Once CS− mutants are identified and isolated, clones are propagated for further analysis.

Concurrent with the mutagenesis of one culture of *R. rhodochrous,* a second culture is maintained, *R. rhodochrous,* that expresses a substance with carbon-sulfur bond cleavage activity (CS+). DNA is extracted from this organism. Various methods of DNA extraction are suitable for isolating the DNA of this organism. Suitable methods include phenol and chloroform extraction. See Maniatis et al., *Molecular Cloning, A Laboratory Manual,* 2d, Cold Spring Harbor Laboratory Press, page 16.54 (1989), herein referred to as Maniatis et al.

Once the DNA is extracted from *R. rhodochrous,* the DNA is cut into fragments of various kilobase lengths, collection of which makes up the DNA library. Various methods of fragmenting the DNA of *R. rhodochrous* to free the DNA of the present invention, may be used including enzymatic and mechanical methods. Any four-base recognition restriction endonuclease such as TagI or Sau 3A is suitable for fragmenting the DNA. Suitable methods of fragmenting DNA can be found in Maniatis et al.

The various DNA fragments are inserted into several mutant clones of *R. rhodochrous,* with the purpose of isolating the fragment of DNA, which encodes a biocatalyst. The transformation of a previously CS− mutant cell to a CS+transformed cell is evidence that the inserted DNA fragment encodes a biocatalyst. Any method of inserting DNA into *R. rhodochrous* which allows for the uptake and expression of said fragment is suitable. In a preferred embodiment, electroporation is used to introduce the DNA fragment into *R. rhodochrous.* See Maniatis et al.

Once transformed mutant *R. rhodochrous* has been produced and identified, DNA fragment encoding the CS+biocatalyst can be identified and isolated. The encoded biocatalyst can then be produced using the isolated DNA in various methods well-known and readily available to those skilled in the art. In addition the isolated DNA can be sequenced and replicated by methods known by those skilled in the art (See Maniatis et al.).

DNA isolated by the above described method can be isolated from any organism which expresses a biocatalyst capable of selectively cleaving carbon-sulfur bonds in a sulfur-bearing hydrocarbon. They include *Bacillus sphaericus* ATCC No. 53969 as reported in U.S. Pat. No. 5,002,888, the teachings of which are incorporated herein by reference.

Other methods of isolating the DNA of the present invention, include variations on the rational used above. For example, it would be possible to randomly insert a CS− DNA plasmid into clones of a CS+strain of *R. rhodochrous.* DNA encoding a CS+biocatalyst could then be identified by screening for clones that have been transformed from CS+to CS−.

The recombinant DNA molecule of the present invention is intended to encompass any DNA resulting from the insertion into its chain, by chemical or biological means, a gene encoding a biocatalyst capable of selectively cleaving carbon-sulfur bonds, said gene not originally present in that chain. Recombinant DNA includes any DNA created by procedures using restriction nucleases, nucleic acid hybridization, DNA cloning, DNA sequencing or any combination of the preceding. Methods of construction can be found in Maniatis et al., and in other methods known by those skilled in the art. The term "recombinant DNA", as used herein, is intended to encompass any DNA resulting from the insertion into the chain, by chemical or biological means, of a DNA not originally present in that chain.

Procedures for the construction of DNA plasmid vectors of the present invention include those described in Maniatis et al. and other methods known by those skilled in the art. Suitable plasmid vectors include pRF-29 and pRR-6. The term "DNA plasmid vector" is intended any replication competent vector which has the capability of having DNA inserted into it and, subsequently, the expression of that DNA insert by an appropriate host cell. In addition, the plasmid vector must be receptive to the insertion of a DNA plasmid containing the genes of the present invention where the gene encodes a biocatalyst which has the capability to selective cleave carbon-sulfur bonds. Procedures for the construction of DNA plasmid vectors include those described in Maniatis et al. and others known by those skilled in the art.

The plasmids of the present invention include any DNA fragment containing the genes of a DNA which encode a biocatalyst which has the capability to selective cleave carbon-sulfur bonds. The term "plasmid" is intended to encompass any DNA fragment. The DNA fragment should be transmittable to a host microorganism by transformation or conjugation. Procedures for the construction or extraction of DNA plasmids include those described in Maniatis et al. and others known by those skilled in the art.

The transformed microorganisms of the present invention can be created by various methods by those skilled in the art. For example, transfection electroporation as explained by Maniatis et al. can be used. By the term "microorganisms" or "organism" is intended any organism capable of the uptake and expression of foreign DNA, i.e., DNA not originally a part of the organism nuclear material. Suitable organisms may include Corynebacterium or Escherichia.

In the biocatalytic desulfurization stage of multistage deep desulfurization, the liquid fossil fuel containing sulfur-bearing heterocycles is combined with the biocatalyst preparation. The relative amounts of biocatalyst preparation and liquid fossil fuel can be adjusted to suit particular conditions, or to produce a particular level of residual sulfur in the treated, deeply desulfurized fossil fuel. The amount of biocatalyst preparation to be combined with a given quantity of liquid fossil fuel will reflect the nature, concentration and specific activity of the particular biocatalyst used, as well as the nature and relative abundance of inorganic and organic sulfur compounds present in the substrate fossil fuel and the degree of deep desulfurization sought or considered acceptable.

The specific activity of a given biocatalyst is a measure of its biocatalytic activity per unit mass. Thus, the specific activity of a particular biocatalyst depends on the nature or identity of the microorganism used or used as a source of biocatalytic enzymes, as well as the procedures used for preparing and/or storing the biocatalyst preparation. The concentration of a particular biocatalyst can be adjusted as desired for use in particular circumstances. For example, where a culture of living microorganisms (e.g., ATCC No. 53968) is used as the biocatalyst preparation, a suitable culture medium lacking a sulfur source other than sulfur-bearing heterocycles can be inoculated with suitable microorganisms and fermented until a desired culture density is reached. The resulting culture can be diluted with additional medium or another suitable buffer, or microbial cells present in the culture can be retrieved e.g., by centrifugation, and resuspended at a greater concentration than that of the original culture. The concentrations of non-viable microorganism and of enzyme biocatalyst preparations can be adjusted similarly. In this manner, appropriate volumes of biocatalyst preparations having predetermined specific activities and/or concentrations can be obtained.

The volume and relative concentration of a given biocatalyst preparation needed for treatment is also related to the nature and identity of the substrate fossil fuel. Substrates that are very high in sulfur-bearing heterocycles, or for which a very low level of residual sulfur is sought will require treatment by biocatalysts of high specific activity and/or high concentration. It is preferable to minimize the degree to which the substrate must be diluted with the biocatalyst; thus, smaller volumes of higher concentration and/or specific activity biocatalyst preparations are preferred. As a general rule, it is preferable that the biocatalyst preparation not exceed one-tenth of the volume of the combined biocatalyst and liquid fossil fuel during treatment. In some embodiments, the biocatalyst is added in substantially nonaqueous or solid form. For example, nonaqueous formulations of enzyme biocatalysts, or immobilized enzyme biocatalysts, can be used.

Other conditions that affect the rate and extent of BDS treatment according to the present invention include the physical conditions to which the substrate fossil fuel/biocatalyst preparation mixture is exposed. The mixture can be incubated at any temperature between the pour point of the liquid fossil fuel and the temperature at which the biocatalytic agent is inactivated. Preferably, biocatalytic desulfurization is carried out at a temperature between about 10° C. and about 60° C. Ambient temperature is preferred when using biocatalyst preparations of or derived from ATCC No. 53968 microorganisms. If desired, the mixture can be subjected to mechanical agitation to accelerate the rate of BDS by ensuring thorough and even distribution of the biocatalyst preparation in the substrate. Suitable means for introducing mechanical agitation include, for example, incubation in a stirred-tank reactor. Alternatively, the substrate fossil fuel can be caused to flow through or over a filter, membrane or other solid support to which an immobilized biocatalyst preparation is affixed.

The mixture of biocatalyst and substrate fossil fuel can be incubated for a predetermined period of time, a sufficient period of time for the desired level of deep desulfurization to be attained. Following BDS treatment, the biocatalyst is separated from the treated fossil fuel using known techniques such as decanting, water extraction or fractional distillation. Immobilized biocatalysts are particularly well-suited for separation from the treated fossil fuel. Enzyme biocatalysts immobilized on a resin or on beads can be recovered by centrifugation, and enzymes affixed to membranes or filters can be recovered, e.g., by filtering the treated fossil fuel therethrough.

If an oxidative or aerobic biocatalyst is used (e.g., ATCC No. 53968 microorganisms or enzymes obtained therefrom), and it is desired to increase the level of oxygen present in the biocatalyst/substrate fossil fuel mixture, oxygen can be supplied to the substrate prior to treatment or during biocatalysis, using conventional techniques such as sparging or bubbling an oxygen source therethrough, or agitating the mixture during biocatalysis under an aerobic atmosphere. Air, compressed air, oxygen enriched air or purified oxygen can be used. In many instances, it will be preferable to add the oxygen source directly to the substrate, due to the greater solubility of oxygen in petroleum, relative to its solubility in aqueous systems.

As noted above, non-viable microorganism or enzyme biocatalysts can be used under conditions other than the conditions needed to maintain the viability of a culture of biocatalytic microorganisms. Nonaqueous media such as perfluorochemicals (PFCs), which are known to have a high capacity to dissolve oxygen, may be used to reconstitute or suspend such a biocatalyst preparation. Oxygen-rich nonaqueous media may accelerate the rate of biocatalysis by an oxidative biocatalyst.

In the present method, the synergistic combination of a conventional desulfurization treatment such as HDS in one stage with biocatalytic desulfurization in another stage culminates with the deep desulfurization of the liquid fossil fuel. Several suitable techniques for monitoring the rate and extent of deep desulfurization are well-known and readily available to those skilled in the art. Baseline and timecourse samples can be collected from the incubation mixture, and prepared for a determination of the residual sulfur in the substrate fossil fuel, e.g., by allowing the fuel to separate from an aqueous biocatalyst, or extracting the mixture with water. The disappearance of inorganic sulfur, labile organosulfur compounds and refractory organosulfur compounds such as DBT, and/or the appearance of desulfurized hydrocarbons formed therefrom, can be monitored using a gas chromatograph coupled with mass spectrophotometric (GC/MS), nuclear magnetic resonance (GC/NMR), infrared spectrometric (GC/IR), X-ray fluorescence (GC/XRF) or atomic emission spectrometric (GC/AES, flame spectrometry) detection systems. In addition, the total residual sulfur content of the deeply desulfurized liquid fossil fuel can be monitored by analyzing one or more unchromatographed samples for the presence of sulfur atoms.

The following discussion illustrates certain practical considerations incident to implementation the present invention at a typical petroleum refining facility. For ease and convenience, an embodiment of the invention in which HDS treatment is combined with BDS treatment is discussed; this is not intended to be limiting on the invention described herein in any way.

Figure 2A:
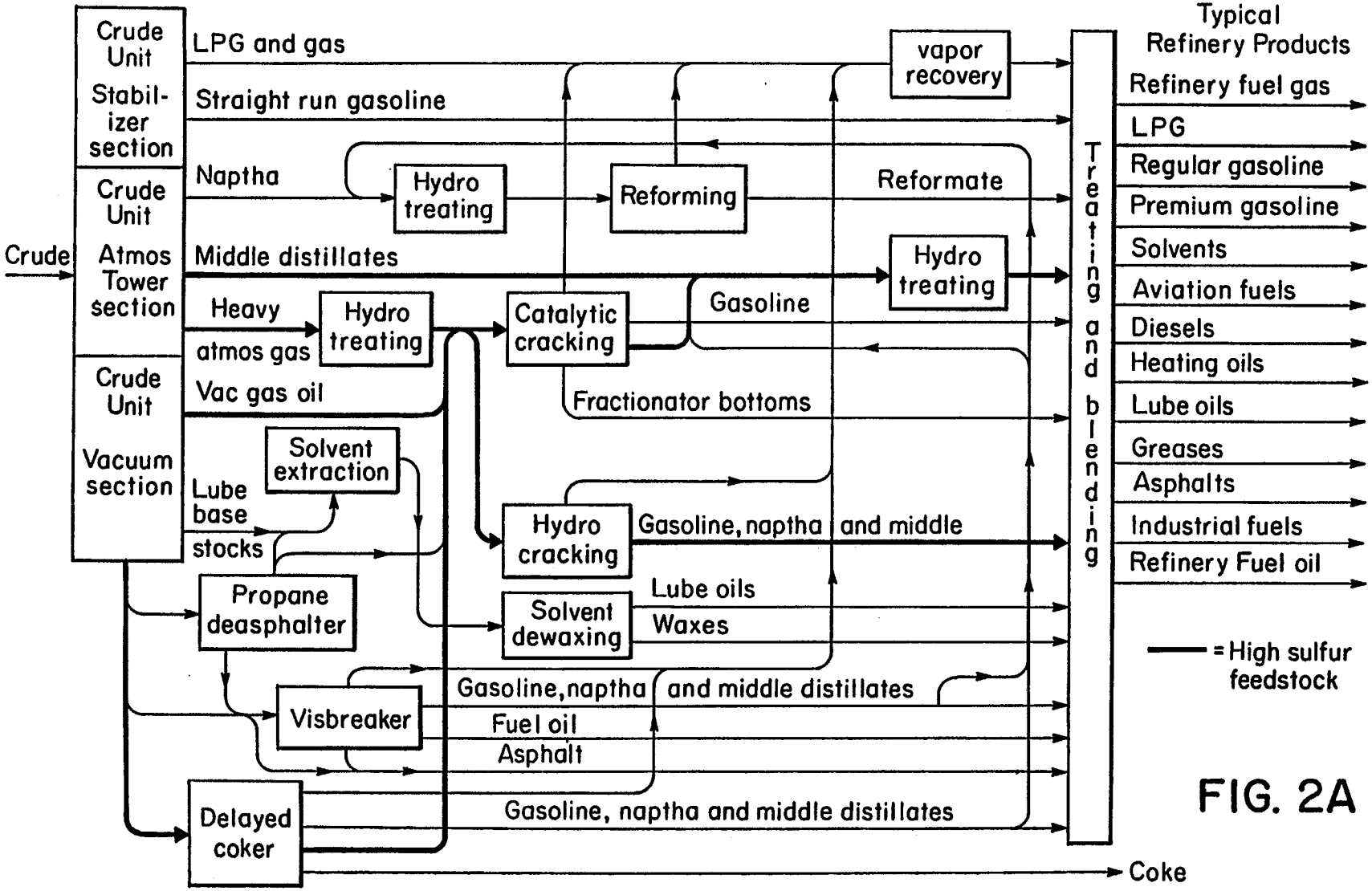
FIG. 2A is an overview of the processing of a typical crude oil sample through a conventional petroleum refining facility, in the form of a flow chart diagram; the routes taken by petroleum fractions containing HDS-refractory sulfur compounds shown as heavy dark lines.
Figure 2B:
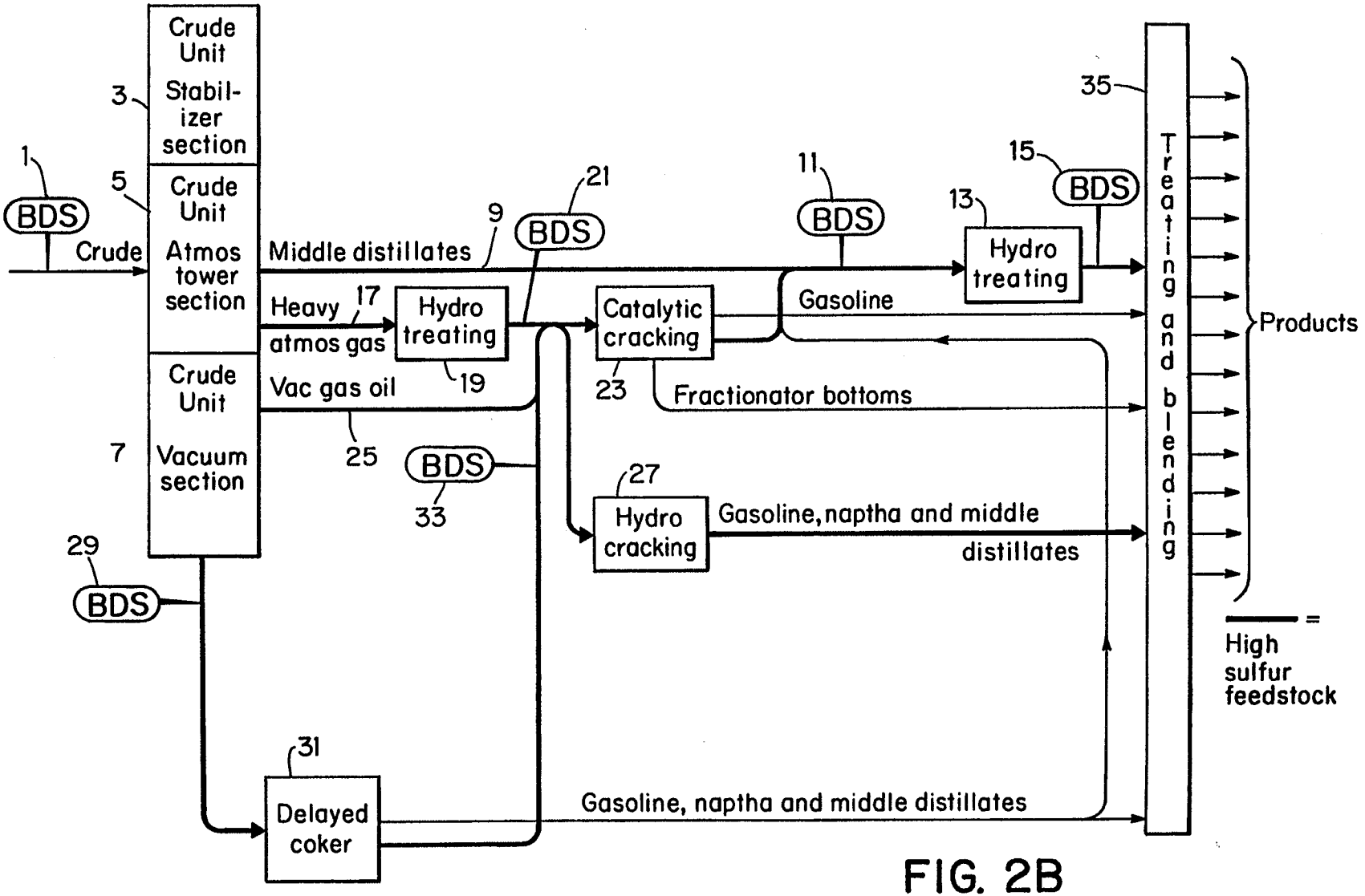
FIG. 2B is a flow chart diagram of relevant portions of the refining overview of FIG. 2A, showing several possible points at which the BDS stage of the present invention can be advantageously implemented.

Depending on the nature of the particular facilities used, and the origin of the substrate fossil fuel, it may be advantageous to implement the BDS treatment stage of the present invention either before or after conventional desulfurizing treatments, such as HDS. This point is illustrated in FIG. 2. FIG. 2A provides an overview of current practices for the refining of a typical crude oil, and a selection of the products which may be produced in a typical facility. The routes of petroleum fractions enriched in total sulfur content or in HDS-refractory sulfur content are shown as heavy dark lines. FIG. 2B focusses on portions of the refining process which are relevant to the instant multistage deep desulfurization system. In particular, several points along the routes taken by the high-sulfur petroleum fractions are shown at which a processing unit suitable for the biocatalytic desulfurization of HDS-refractory organosulfur compounds can be advantageously implemented.

The raw or unrefined liquid can be subjected to BDS at its point of entry into the refining facility 1, prior to passage through the crude unit stabilizer 3, crude unit atmospheric distiller 5, and crude unit vaccuum distiller 7. Typically, the atmospheric middle distillate fractions 9 contain HDS-refractory organosulfur compounds, which can advantageously be BDS treated either prior to (11), or following (15), a mild hydrotreating (HDS) polishing step 13. The treated petroleum fractions are then subjected to a final treating and blending step 35, where they are formulated into products such as regular or premium gasoline, or diesel fuel.

The heavy atmospheric gas 17 (i.e., the remaining liquid from the atmospheric distillation) also contains HDS-refractory organosulfur compounds, and is normally subjected to a hydrotreating step 19. This can advantageously be followed by a BDS step 21 prior to either catalytic cracking 23 or hydrocracking 27, in which high molecular weight hydrocarbons are converted into smaller molecules more appropriate for fuel formulations. The products of the cracking step can also optionally be subjected to BDS before or after (11 or 15) additional hydrotreating 13. If the cracked hydrocarbons need no further desulfurization, they are subjected to the final treating and blending step 35, where they are formulated into products such as regular or premium gasoline, diesel fuel or home heating oil.

The products of the crude unit vaccuum distillation 7 are typically enriched for organosulfur compounds, especially high molecular weight HDS-refractory organosulfur compounds such as sulfur-bearing heterocycles. The vaccuum gas oil 25 is processed in essentially the same manner as the heavy atmospheric gas 17: it can optionally be subjected to BDS at 21, prior to either catalytic cracking 23 or hydrocracking 27. If desired, the products of the cracking step can be subjected to BDS before or after (11 or 15) additional hydrotreating 13. Alternatively, the products can be routed to the final treating and blending step 35, where they are formulated into products such as regular or premium gasoline, diesel fuel, home heating oil, or various greases.

The residue remaining after the crude unit vaccuum distillation 7 is typically quite high in sulfur content, which can advantageously be decreased by BDS at 29. The residue is next introduced into a delayed coker unit 31, which, if desired, can be followed by BDS at 33. The residue can then be treated as for the vaccuum gas oil, i.e., subjected to either catalytic cracking 23 or hydrocracking 27. The cracked hydrocarbons can optionally be subjected to BDS prior to or following (11 or 15) an additional hydrotreating step 13, or can proceed directly to the final treating and blending step 35, for formulation into products such as regular or premium gasoline, diesel fuel, home heating oil, various greases, or ashphalt.

As noted previously, there are inherent advantages to positioning biocatalytic desulfurization at each of the above-listed positions in the refining process. Implementation of an early stage (e.g., 1) BDS is advantageous because the crude oil arrives at the refinery already "contaminated" with some aqueous liquid. Procedures for removing this aqueous phase during refining are well known and commonly employed; thus, any additional aqueous contamination from biocatalytic treatment would be incidental and readily removed. Moreover, as the value of unrefined crude oil is considerably lower than its refined and formulated products, and as the raw commodity can economically be purchased in advance and stored on-site, an extended biocatalytic deep desulfurization incubation is feasible and would facilitate downstream production of valuable fuel products. However, the large scale and low relative abundance of HDS-refractory sulfur-bearing heterocycles in the substrate at the beginning of the refining process may present obstacles to biocatalysis at this stage. Further, a significant safety factor must be taken into account: oxygenation of unfractionated crude oil may produce an explosive mixture, depending on the types and relative abundance of low molecular weight flammable components in the raw fossil fuel.

It is generally more advantageous to subject petroleum fractions enriched in HDS-refractory organosulfur compounds, or depleted of HDS-labile organosulfur compounds, to the biocatalysis stage of this invention. In this manner, the fractions subjected to BDS will have smaller volumes but be concurrently enriched in total or HDS-refractory sulfur content. Biocatalytic desulfurization may be advantageously implemented at positions such as 11, 15, 21, 29, or 33. In making the decision where best to deploy a BDS unit, certain aspects of HDS treatment must be considered. In particular, it must be borne in mind that although inadequate as a stand-alone method for deep desulfurization, HDS remains a beneficial and, in many instances, necessary refining step. The conditions encountered in HDS are sufficient not only to remove sulfur from labile organosulfur compounds, but also to remove excess oxygen and nitrogen from organic compounds, and to induce saturation of at least some carbon-carbon double bonds, thereby increasing the fuel value of the treated petroleum fraction. In a broader context, this physicochemical process is commonly referred to as hydrotreating rather than HDS. Gary and Handwerk (1975), PETROLEUM REFINING: TECHNOLOGY AND ECONOMICS 114–120 (Marcel Dekker, Inc., publ.). The cosmetic quality of the fuel product is also improved, as many substances having an unpleasant smell or color are removed. Hydrotreating also clarifies the product, by drying it (depleting it of residual water, which produces a cloudy appearance). Several commercial petroleum products, such as gasoline or diesel fuel, must meet fairly stringent specifications; hydrotreating is one commonly used method to ensure that these products comply with applicable standards. Thus, biocatalytic desulfurization of a suitable petroleum fraction can frequently be followed by a hydrotreating polishing step, as at 11, 21, or 33.

Although hydrotreating or HDS can be advantageous to the production of specific fuel products, severe HDS conditions are to be avoided, since they have been reported to be actively detrimental to the integrity of the desired products. For example, Shih et al. caution that exposure of petroleum refining fractions to typical HDS conditions at temperatures in excess of about 680° F. decreases the fuel value of the treated product. In order to achieve deep desulfurization solely through the use of HDS, petroleum refining fractions which contain significant amounts of refractory sulfur-bearing heterocycles must be exposed to temperatures in excess of this threshold. For example, FCC light cycle oil must be subjected to HDS at temperatures as high as 775° F. if deep desulfurization is to be attempted using conventional techniques. In effect, such petroleum refining fractions cannot be converted into desirable, clean burning fuel products, such as gasoline or diesel fuel, in the absence of the synergistic combination of desulfurizing treatments disclosed herein.

In addition, the attempted HDS-desulfurization of substrates rich in refractory organosulfur compounds, or even of a refining fraction highly enriched in labile organosulfur compounds, requires a substantial input of $H_2$ gas. This is an expensive commodity; typically, any excess $H_2$ gas is trapped and recycled. However, it is frequently necessary for a refining facility to construct a hydrogen-generation unit and integrate it into the refining process. Speight (1981), THE DESULFURIZATION OF HEAVY OILS AND RESIDUE 119–127 (Marcel Dekker, Inc., publ.). This is a capital-intensive undertaking, making it a desirable refining step to avoid.

Moreover, exposure of the chemical catalysts used for HDS to excessive concentrations of $H_2S$, the gaseous inorganic sulfur product formed as a result of HDS, is known to poison the catalyst, thus prematurely shortening the duration of its utility. Extended HDS treatment of complex organosulfur compounds, especially refractory compounds, at elevated temperatures is also known to result in the deposition of carbonaceous coke on the catalyst. These factors contribute materially to the premature inactivation of the chemical HDS catalyst.

The foregoing considerations demonstrate that a significant advantage of the instant multistage process for deep desulfurization of liquid fossil fuels is that it allows the use of milder HDS conditions than would otherwise be required, by providing for biocatalytic removal of the refractory organosulfur compounds, such as DBT and radical-decorated derivatives thereof, which require harsh or difficult-to-maintain conditions such as excessive temperature or $H_2$ input. Mild hydrotreating, such as at 13 or 19 can be either preceeded (e.g., 11) or followed (e.g., 15, 21) by biocatalytic desulfurization to remove refractory compounds. In this manner, desirable fuel products are manufactured at lower capital cost, without exposure of either the petroleum fraction or the refining equipment and components to potentially dangerous or deleterious conditions, even from refining fractions which previously were not considered to be available for the manufacture of deeply desulfurized fuel products.

The invention will now be further illustrated by the following representative examples, which are not to be viewed as limiting in any way.

Example 1. BDS Treatment of a Typical Middle Distillate with a culture of living ATCC No. 53968 microorganisms.

A petroleum distillate fraction, similar in specific gravity and other properties to a typical middle distillate (9 in FIG. 2B) or a heavy atmospheric gas oil (17) or a vacuum gas oil (25) or the material from a delayed coker, having an initial sulfur content of 0.51 wt %, was treated with a preparation of Rhodococcus Sp. ATCC No. 53968. The biocatalyst preparation consisted of an inoculum of the bacteria in a basal salts medium, comprising:

TABLE 1

| Component | Concentration |
|---|---|
| $Na_2HPO_4$ | 0.557% |
| $KH_2PO_4$ | 0.244% |
| $NH_4Cl$ | 0.2% |
| $MgCl_2 \cdot 6H_2O$ | 0.02% |
| $MnCl_2 \cdot 4H_2O$ | 0.0004% |
| $FeCl_3 \cdot 6H_2O$ | 0.0001% |
| $CaCl_2$ | 0.0001% |
| glycerol | 10 μM |

The bacterial culture and the substrate petroleum distillate fraction were combined in the ratio of 50:1 (i.e., a final concentration of 2% substrate). The BDS stage of deep desulfurization was conducted in shake flasks with gentle agitation at ambient temperature for 7 days. Subsequent analysis of the treated distillate fraction revealed that the wt % sulfur had fallen to 0.20%, representing a 61% desulfurization of the substrate petroleum liquid. Characterization of the sample before and after BDS treatment by gas chromotography coupled to a sulfur-specific detector demonstrated that prior to treatment, the sample contained a broad spectrum of organosulfur compounds. Due to the action of the ATCC No. 53968 biocatalyst, the levels of a broad range of these molecules were reduced in the post-BDS sample, including sulfur-bearing heterocycles such as DBT and radical-decorated derivatives thereof.

Example 2. BDS and HDS Treatment To Remove Sulfur from HDS-Refractory Organosulfur Compounds.

A sample of the hydrodesulfurization feedstock analyzed in *Deep Desulfurization of Distillate Components* by S. S. Shih et al. has been obtained and subjected to BDS treatment for multistage deep desulfurization according to the present invention. In FIG. 1 of the monograph corresponding to Shih et al., gas chromatograph tracings of this sample are depicted, prior to and following successive rounds of HDS treatment under increasingly severe conditions. These chromatograph tracings demonstrated the ineffectiveness of HDS in removing refractory organosulfur compounds such as complex sulfur-bearing heterocycles (e.g., DBT), even when the sample was subjected to HDS treatment under conditions sufficiently harsh to impair the fuel value of the treated product.

A 250 mL sample of the HDS feedstock of Shih et al. was combined with 750 mL of ATCC No. 53968 culture, prepared generally as described in Example 1, in a 2L stirred batch reactor. The pH of the system was monitored and controlled at 7.5 and the reaction was allowed to run for 48 hours. The contents of the bioreactor were separated by centrifugation, and the oil phase was analyzed by gas chromatography with a flame photometric detector specific for sulfur. A sample of the original feedstock was similarly analyzed.

The chromatogram tracings of the Shih et al. sample, before and after BDS treatment, were superimposed to facilitate a peak-to-peak comparison. The heights of all peaks were reduced following BDS treatment, indicating desulfurization over a broad spectrum of structurally and chemically diverse organosulfur compounds. However, in contrast to FIG. 1 of Shih et al., the heavier molecules appearing in the latter portion of the chromatogram, including DBT (which has a retention time of 22 min. under the conditions used) and radical-decorated derivatives thereof, were desulfurized to a greater extent than the light-end organosulfur compounds that are labile to HDS. Thus, biocatalytic desulfurization had a greater effect on refractory compounds, such as sulfur-bearing heterocycles, which normally account for a substantial proportion of the residual sulfur present in combustible fuel products that have been subjected to conventional treatments such as HDS.

This result demonstrates that biocatalytic desulfurization does not act on the same classes of organosulfur molecules as those susceptible to HDS or to conventional MDS treatment. Rather, these results show that the two treatments (HDS and BDS) combine synergistically to remove sulfur from a broader spectrum of organosulfur compounds than could be desulfurized by either technique alone. In this manner, a deeply desulfurized liquid fossil fuel is produced according to the present invention without concomitant loss in fuel value due to exposure of the desulfurization feedstock to destructive conditions as reported in Shih et al.

Example 3. Use of Multistage Deep Desulfurization to Produce a Liquid Fossil Fuel Having a Total Residual Sulfur Content Below About 0.05 wt %.

A light distillate (No. 1 diesel, a fraction which would typically be obtained by mild hydrotreating, e.g., at 13 in FIG. 2B), initially containing 0.12% sulfur, was treated with the ATCC No. 53968 biocatalyst as described in Example 1. The residual sulfur compounds in this sample were mainly benzothiophene, radical-decorated derivatives of benzothiophene, DBT and radical decorated derivatives of DBT, as would be expected from a sample subjected to HDS treatment under moderate conditions. Through BDS treatment, the residual sulfur level of this substrate was reduced to 0.04 wt %. These results demonstrate that samples enriched in sulfur-bearing heterocycles, whether naturally occurring or artificially enriched due to prior HDS treatment, can be deeply desulfurized using the multistage process described herein.

Example 4. Preparation of a cell-free biocatalyst from ATCC No. 53968; Use of same in BDS Treatment.

A culture of R. Sp. ATCC No. 53968 was prepared by standard fermentation methods, generally as described in Example 1. Intact bacterial cells were disrupted or lysed by sonication using an MSE brand sonicator equipped with a 16 mm diameter probe. The progress of cell lysis was monitored by tracking the appearance of soluble proteins (using a standard Bradford protein assay kit, such as that marketed by BioRad, according to the manufacturer's directions). Maximal protein release (indicating maximal lysis) from a concentrated suspension of intact ATCC No. 53968 bacteria was observed following 4–6 cycles of sonication (wherein one cycle comprises 30 seconds of sonication followed by a 30 second incubation on melting ice).

The preparation of lysed bacteria was then fractionated by centrifugation. A "cell debris" fraction (comprising cell wall fragments) was obtained as a pellet following centrifugation for 5 minutes at 6,000 xg. This fraction was demonstrated to contain biocatalytic desulfurization activity, as determined by Gibb's assay for the presence of 2-hydroxybiphenyl (2-HBP, FIG. 1C), the observed hydrocarbon product of oxidative biocatalytic desulfurization of DBT by ATCC No. 53968. The procedure for Gibb's assay was as follows:

Cell or cell fraction harvest. Cells or cell envelope fraction was centrifuged in a Sorvall GSA or ss34 rotor at 8,000xg for 20 minutes at room temperature. The resulting pellet was washed in 0.05 M phosphate buffer, pH 8.0, and resuspended in the same buffer. A sample was withdrawn and diluted 1:10 or 1:20 in phosphate buffer, and the optical absorbance of the suspension at 600 nm was determined. Thereafter, the volume was adjusted to yield a suspension having an $A_{600}$ in excess of 3.0, and preferably of about 4.0. This concentration was verified by withdrawing a sample, diluting it 1:10 and confirming its $A_{600}$ in the range of 0.300–0.400.

BDS incubation. Enzyme reactions were conducted in small flasks or large-diameter test tubes, which provide adequate volume for agitation/aeration. All reactions were in excess of about 5 mL. For each reaction, approximately 1 mg DBT was added per mL of cell or cell envelope suspension (a 5 mM addition of DBT to a 25 mL reaction requires 23 mg DBT; thus, reactions were adjusted to contain about 5 mM enzyme substrate). Reaction mixtures were transferred to a 30° C.

water bath, and subjected to agitation at 200 rpm. It was noted that there is an initial lag in BDS activity; therefore, a zero time sample was considered optional. After 1, 2 and 3 hours of incubation, 1.5 mL samples were withdrawn from each reaction mixture and pelletted at about 12,000 rpm for 4 minutes in an Eppendorf microfuge. One milliliter samples of the resulting supernatants were transferred to 1.5 mL Eppendorf tubes for assay. It was found that these supernatant samples could be stored at 4° C. for several days prior to assay, if desired.

Gibb's assay. 0.1 g Gibb's reagent (2,6-dichloroquinone-4-chloroimide; obtained from Sigma Chemical Co.) was dissolved in 10 mL absolute ethanol in a test tube, and promptly protected from light by wrapping the tube in foil. This solution was prepared freshly each day. To each Eppendorf tube containing 1.0 mL supernatant adjusted to pH 8.0, 10 μL Gibb's reagent was added. After a 30 minute incubation at room temperature, the appearance of the blue product of reaction between Gibb's reagent and 2-HBP was monitored by measuring the increase in optical absorbance of the assay mixture at 610 nm, relative to the $A_{610}$ of a sample containing phosphate buffer rather than supernatant. Results were expressed as units of absorbance per hour, per unit of cell material (one unit of cell material is defined as the amount of cell/cell envelope suspension which, when suspended in water, yields an $A_{600}$ of 1.0).

Results of this study are summarized in Table 2.

TABLE 2

Biocatalytic Desulfurization by intact, lysed, and a cell-free fraction obtained from ATCC No. 53968

| Biocatalyst | Change in Absorbance (610 nm) per Hour per Unit Cell Material | Number of Determinations |
|---|---|---|
| Washed intact cells | 0.085 ± 0.007 | n = 4 |
| Freeze-Thaw lysed cells (unfractionated) | 0.060 ± 0.001 | n = 2 |
| Sonicated lysed cells (cell debris fraction) | 0.035 ± 0.002 | n = 2 |

These results demonstrate that a substantial proportion of the total biocatalytic desulfurizing activity expressed by the ATCC No. 53968 microorganism is found in the "cell debris fraction" which contains external cell membrane and cell wall fragments. Thus, in the ATCC No. 53968 microorganism, the enzyme biocatalyst responsible for desulfurization is a component of the cell envelope (comprising the bacterial cell wall and cell membrane). Non-viable intact microorganisms can thus be used as the biocatalyst for BDS treatment, as can cell-free preparations that contain appropriate enzymatic activity.

EQUIVALENTS

Those skilled in the art will recognize, or be able to ascertain using no more than routine experimentation, many equivalents to the specific embodiments of the invention described herein. These and all other such equivalents are intended to be encompassed by the following claims.

I claim:

1. A method for the deep desulfurization of a liquid fossil fuel containing organic sulfur, said organic sulfur comprising aromatic sulfur-bearing heterocycles, comprising the steps of:

(a) subjecting the liquid fossil fuel to hydrodesulfurization (HDS), whereby sulfur susceptible to the removal by HDS is removed from the liquid fossil fuel;

(b) contacting the liquid fossil fuel obtained from step (a) with a biocatalyst in an aqueous medium in an amount and under conditions sufficient for the conversion of the organic sulfur of the aromatic sulfur-bearing heterocycles to inorganic sulfur, wherein the biocatalyst comprises enzymes that catalyze the removal of sulfur from aromatic sulfur-bearing heterocycles obtained as a lysate, extract, fraction or subfraction of one or more microorganisms that catalyze the removal of sulfur from aromatic sulfur-bearing heterocycles thereby preparing a deeply desulfurized liquid fossil fuel; and (c) separating the deeply desulfurized liquid fossil fuel from the aqueous medium.

2. A method according to claim 1, wherein the enzymes are obtained from Rhodococcus sp. ATCC No. 53968 or a mutant of Rhodococcus sp. ATCC. No. 53968 having the capability of the parent microorganism for catalyzing the removal of sulfur from aromatic sulfur-bearing heterocycles.

3. A method according to claim 2, including the additional step of contacting said liquid fossil fuel with a source of oxygen prior to step (b) such that oxygen tension in said fossil fuel is increased.

4. A method according to claim 3, wherein the liquid fossil fuel is petroleum, a petroleum refining intermediate, refined petroleum, or a coal-derived liquid.

5. A method according to claim 1, wherein the biocatalyst removes sulfur from aromatic sulfur-bearing heterocycles by a sulfur-specific oxidative cleavage reaction.

6. A method according to claim 5, comprising the additional step of contacting the liquid fossil fuel with a source of oxygen prior to step (b) such that oxygen tension in said fossil fuel is increased.

7. A method for the deep desulfurization of a liquid fossil fuel containing organic sulfur, said organic sulfur comprising aromatic sulfur-bearing heterocycles, comprising the steps of:

(a) subjecting the liquid fossil fuel to hydrodesulfurization (HDS), whereby sulfur susceptible to the removal by HDS is removed from the liquid fossil fuel;

(b) contacting the liquid fossil fuel obtained from step (a) with a biocatalyst in an aqueous medium in an amount and under conditions sufficient for the conversion of the organic sulfur of the aromatic sulfur-bearing heterocycles to inorganic sulfur, wherein the biocatalyst comprises enzymes that catalyze the removal of sulfur from aromatic sulfur-bearing heterocycles obtained as a lysate, extract, fraction or subfraction of one or more microorganisms that catalyze the removal of sulfur from aromatic sulfur-bearing heterocycles thereby preparing a deeply desulfurized liquid fossil fuel; and (c) separating the deeply desulfurized liquid fossil fuel from the aqueous medium;

wherein the deeply desulfurized liquid fossil fuel contains below about 0.05 wt % sulfur.

8. A method according to claim 7, wherein the enzymes are obtained from Rhodococcus sp. ATCC No. 53968 or a mutant of Rhodococcus sp. ATCC. No. 53968 having the capability of the parent microoganism for catalyzing the removal of sulfur from aromatic sulphur-bearing heterocycles.

9. A method according to claim 7, including the additional step of contacting the liquid fossil fuel with a source of oxygen prior to step (b) such that oxygen tension in said fossil fuel is increased.

* * * * *